US007596838B1

(12) United States Patent
Bulmer

(10) Patent No.: US 7,596,838 B1
(45) Date of Patent: Oct. 6, 2009

(54) LACE LOCK

(76) Inventor: Donald L. Bulmer, 6228 NE. Arrowhead Dr., Kenmore, WA (US) 98028-4340

( * ) Notice: Subject to any disclaimer, the term of this patent is extended or adjusted under 35 U.S.C. 154(b) by 3 days.

(21) Appl. No.: 12/004,764

(22) Filed: Dec. 21, 2007

(51) Int. Cl.
*A43C 7/00* (2006.01)

(52) U.S. Cl. ..... 24/712.9; 24/130

(58) Field of Classification Search ..... 24/18, 24/712.9, 130, 129 R; 114/218; 36/50.1
See application file for complete search history.

(56) References Cited

U.S. PATENT DOCUMENTS

| | | | | |
|---|---|---|---|---|
| 88,175 | A * | 3/1869 | Johnson et al. | 24/130 |
| 371,475 | A * | 10/1887 | Perry | 24/130 |
| 1,251,778 | A * | 1/1918 | Humble | 24/130 |
| 4,790,048 | A | 12/1988 | Arnt | |
| 4,967,454 | A | 11/1990 | Elieff | |
| 4,969,242 | A | 11/1990 | Carlton, Sr. | |
| 4,991,273 | A | 2/1991 | Huttle | |
| 5,467,511 | A * | 11/1995 | Kubo | 24/712.9 |
| 5,572,777 | A | 11/1996 | Shelton | |
| 5,657,557 | A | 8/1997 | Hull et al. | |
| 6,148,489 | A | 11/2000 | Dickie et al. | |
| 6,178,606 | B1 | 1/2001 | Glendon | |
| 6,192,559 | B1 | 2/2001 | Munsell, Jr. | |
| 6,588,079 | B1 | 7/2003 | Manzano | |
| 2002/0092142 | A1 | 7/2002 | Schoen | |
| 2006/0168772 | A1 * | 8/2006 | Sorensen | 24/130 |
| 2008/0110000 | A1 * | 5/2008 | Orr | 24/130 |

FOREIGN PATENT DOCUMENTS

GB 2395223 A 5/2004

OTHER PUBLICATIONS

Donald L. Bulmer, letter to Mr. Dale Emery, Clamcleats limited, England, Aug. 15, 2005.
Dale Emery, reply letter to Mr. Bulmer, USA, Aug. 24, 2005.
Donald L. Bulmer, letter to Schering-Plough Health Care Products, Inc., USA, Sep. 22, 2005.
Nancy Miller-Rich, Schering-Plough Health Care Products, Inc., reply letter to Mr. Donald L. Bulmer, Oct. 3, 2005.
Donald L. Bulmer, letter to Stride Rite, Inc., USA, Sep. 22, 2005.
Sample of prototype "Lace-Lock" device sent with references DA, DC and DE.
Sample of a prior art Clamcleat rope cleat device with hang tag, in public use and on sale in the U.S. more than one year prior to Dec. 21, 2007.

* cited by examiner

*Primary Examiner*—James R Brittain
(74) *Attorney, Agent, or Firm*—Gregory W. Moravan

(57) ABSTRACT

A lace lock for releasably securing an end of a lace on an article. The lace lock may be mounted to the article and have least one channel for releasably securing a free end portion of the lace.

17 Claims, 4 Drawing Sheets

LACE LOCK

STATEMENT REGARDING FEDERALLY SPONSORED RESEARCH OR DEVELOPMENT

There is no federally sponsored research or development regarding the claimed invention.

DETAILED DESCRIPTION OF THE INVENTION

Figure 1:
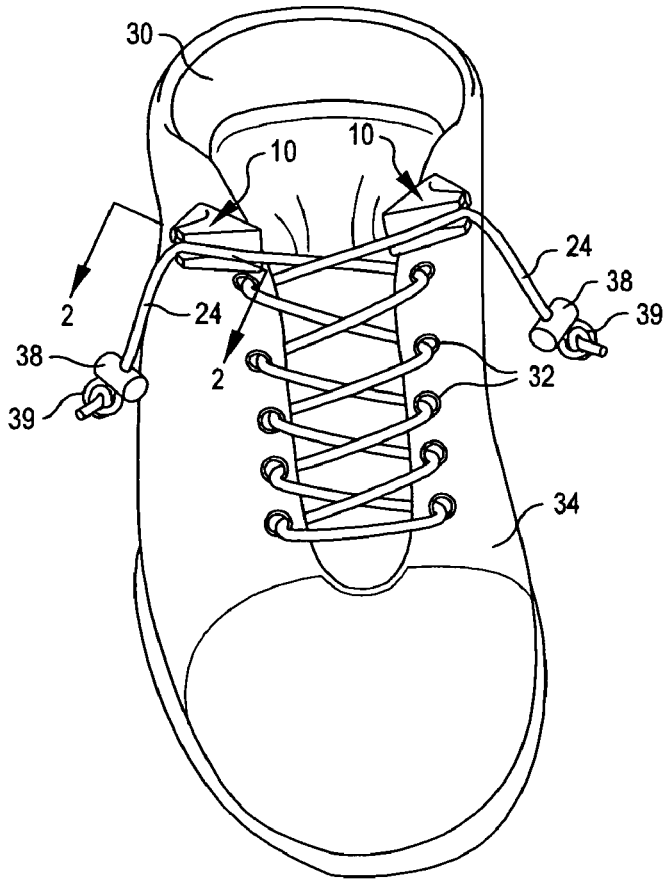
FIG. 1 is a front perspective view showing two lace locks installed on an article of footwear.

Referring now to the Figures, the lace lock 10 is not confined to being used to releasably secure a free end portion of a lace 24 on an article of footwear 30 since it may be used with any kind of laceable article have one or more laces 24, e.g., corsets, medical devices such as back braces, articles of clothing, or sporting goods. Further, the lace lock 10 may be used to releasably secure a free end portion of any lace, cord, string, strand, wire, or the like, even if a laceable article is not involved. For example, it may be used to releasably secure a free end portion of a drawstring on an article such as a duffel bag, or to releasably secure the free end of an article such as tie that is being used to hold a bundle of objects together.

Accordingly, it is to be understood that the description herein of the lace lock 10 being used with an article of footwear 30 is by way of non-limiting example, since all of the comments herein regarding such use of the lace lock 10 will apply equally well to the use of the lace lock 10 with any other kind of article; aside from those differences, if any, which will be made apparent to a person of ordinary skill in the art in view of all of the disclosures herein.

Although the lace lock 10 is illustrated in the Figures as being used with a lace 24 having a circular cross-sectional configuration, the lace lock 10 may be used with a lace 24 having any other size, shape, construction and cross-sectional configuration. As used herein the term "lace" is broadly defined to include any suitable lace, cord, string, strand, wire, or the like.

The lace lock 10 may be made of any suitable material such as plastic or metal, and may be made in any suitable way, such as by being molded, casted, or machined. It may be made in one piece, or it may be assembled from sub-components.

The first embodiment of a lace lock 10 is illustrated in FIGS. 1-3 and 6. The lace lock 10 may comprise a base 12, a bottom 14, a pair of wings 16 supported by the base 12, a boss 18 supported by the base 12, a wing channel 20 defined between the wings 16, a pair of boss channels 26 defined between the wings 16 and the boss 18, and a bore 28 in the base 12 and the boss 18.

Figure 2:
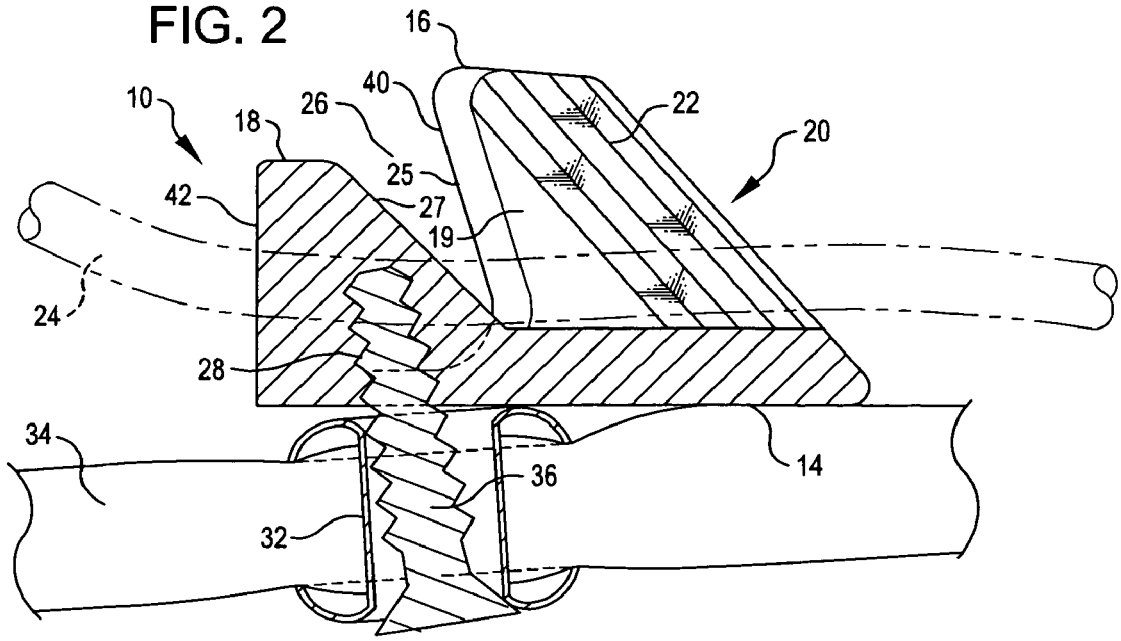
FIG. 2 is a cross-sectional view of a lace lock taken along line 2-2 of FIG. 1.
Figure 3:
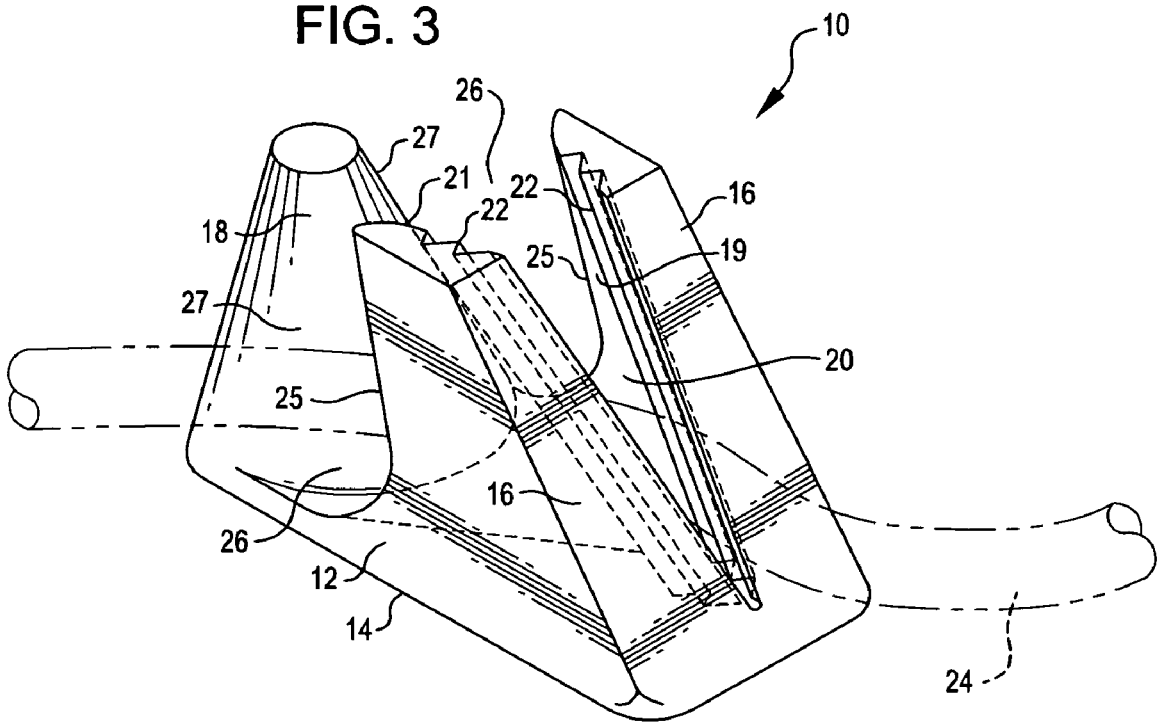
FIG. 3 is a is a front, side perspective view of the lace lock of FIGS. 1-2.

In order to mount a lace lock 10 to an article of footwear 30 having a lace 24 and eyelets 32 in its upper 34, the bottom 14 of the lace lock 10 may be placed over one of the eyelets 32 as best seen in FIG. 2. A mounting screw 36 may then be passed through the eyelet 32 and screwed into the bore 28 in the base 12 and boss 18 to securely mount the lace lock to the upper 34 of the footwear 30. The head of the mounting screw 36 is sized larger than the opening in the eyelet 32, in order to prevent the mounting screw 36's head from passing through the eyelet 32.

As seen in FIG. 2, if the lace lock 10 is molded from plastic, for example, then the bore 28 may be inclined at an angle with respect to the base 14 of the lace lock 10, and the angle may be selected to be the same as the angle that the rear 40 of the wings 16 make with the base 14, to aid in the removal of the lace lock 10 from the mold. Alternatively, the bore 28 may be made in any suitable way after the lace lock 10 has been removed from its mold, such as by drilling the bore 28 at any desired angle with respect to the bottom 14. For example, in the embodiment 10*a* seen in FIG. 4, the bore 28 may be at a right angle with respect to the bottom 14.

As an alternative to using a mounting screw 36 to mount the lace lock 10 to the upper 34 of the footwear 30, the lace lock 10 may be removably or permanently mounted to the footwear 30 in any other suitable way such as, for example, by using a rivet or other kind of removable or non-removable fastener, by using any suitable adhesive, or by using any suitable heat bonding method. If a fastener is not used to mount the lace lock 10, then the bore 28 may be eliminated.

Although the bottom 14 of the lace lock 10 is illustrated as being flat and smooth, it may have any other suitable non-flat configuration such as, for example, being shaped to conform to the shape of the upper 34 of the footwear 30. As a further alternative, the bottom 14 may not be smooth, but may have any suitable non-smooth surface, such as having a textured surface, which might aid, for example, in keeping the lace lock 10 in place once mounted to the footwear 30, or which might aid in mounting the lace lock 10 to the footwear 30, such as if adhesives or heat welding were used to mount the lace lock 10 to the footwear 30.

The lace 24 may have an optional pull 38 at each of its ends to help enable the user to grasp the ends of the lace 24. Each pull 38 may have any size and shape suitable for fulfilling its function of helping the user to more easily manipulate the ends of the lace 24. The pulls 38 may be held on the lace 24 in any suitable way such as, for example, by the use of knots 39 in the ends of the lace 24. The pulls 38 for any particular lace 24 need not be the same.

In order to use a lace lock 10 after it is installed on the footwear 30, the user simply grasps one of the ends of the lace 24 (or its pull 38), and guides the lace 24 into the wing channel 20. The user then guides the lace 24 into one of the boss channels 26, and pulls on the lace 24 (or its pull 38), to firmly engage the lace 24 in the wing channel 20. In order to release the lace 24 from the wing channel 20 the user simply pulls up on a free end portion of the lace 24 (or its pull 38) until the lace disengages from the wing channel 20.

From the forgoing, it will be appreciated that the lace lock 10 is a simple, low cost device that is easily installed on the footwear 30, and may be used to quickly, easily and releasably secure a free end portion of the lace 24. The lace lock 10 will greatly aid anyone who lacks manual dexterity, such as the young, old or infirm; and may even be utilized by a person who has the use of only one hand.

It will also be appreciated that the lace lock 10 may be made in any suitable size. For example, a lace lock 10 that is intended to be mounted to a toddler's footwear 30 may be quite small as compared to a lace lock 10 that is intended to be mounted to an adult's footwear 30.

Further, the lace lock 10 may be installed on the footwear 30 by a user as an after market product (as illustrated in FIG. 2), or it may be installed as original equipment on the footwear 30 by the manufacturer of the footwear 30.

In addition, if the lace lock 10 is mounted to the footwear with a removable fastener, such as with a mounting screw 36, the lace lock 10 may be re-used by simply unscrewing the mounting screw 36, removing the lace lock 10 from the footwear 30, and then using the mounting screw 36 to mount it to another article of footwear 30.

The lace lock 10 need not necessarily be mounted to the footwear 30 or other article by use of a pre-existing eyelet or other opening in the upper 34 of the footwear 30. For example, a new opening for mounting the lace lock 10 may be made in the upper 34 of the footwear 30, or the fastener itself (such as the mounting screw 36) may make its own new opening in the upper 34 of the footwear 30.

Turning now to some of the details of the lace lock 10, its boss 18 may have, as seen, a generally conical shape; aside from its rear surface 42 which may be generally flat. Alternatively, the boss 18 may have any other suitable size and shape.

Alternatively, the boss 18 and its portion of the bore 28 may be eliminated, and any suitable part of the lace lock 10, such as its base 12, may be secured to the footwear 30's upper 34 or to an eyelet 32 in any suitable way such as, for example, by using a screw, rivet, or any other kind of removable or non-removable fastener, by using any suitable adhesive, or by using any suitable heat bonding method. If a fastener is not used to mount this alternative form of the lace lock 10, then the bore 28 in the base 12 may be eliminated.

Regarding the wings 16, they may also have any suitable size and shape other than those illustrated in FIGS. 1-6. The wing channel 20 may have any suitable size, shape and cross-sectional configuration that enables the wing channel 20 to serve the function of helping the wings 16 to releasably secure a lace 24 with which the lace lock 10 may be used. For example, the wing channel 20 may have a V-shaped cross-sectional configuration (i.e., "V-shaped"), as illustrated in FIGS. 1-4 and 6. Although the entire wing channel 20 is illustrated as being V-shaped, only part of the wing channel 20 may be V-shaped.

The width of an upper portion of the V-shaped wing channel 20 may be selected to enable the lace 24 to easily enter the wing channel 20. The width of a lower portion of the V-shaped wing channel 20 may be selected to enable the V-shaped wing channel 20 to releasably secure the lace 24. The size, shape and dimensions of the V-shaped wing channel 20 may be varied, as needed, in order to permit the V-shaped wing channel 20 to releasably secure a lace 24 having any particular size, shape, construction and cross-sectional configuration.

One, or both, of the sides 19, 21 of the wing channel 20 may comprise optional grippers 22 which may serve the function of helping the wing channel 20 to releasably secure the lace 24. Although elongated, serrated grippers 22 are illustrated, it is understood that the grippers 22 may have any other suitable size, shape and construction that helps enable the grippers 22 to perform their function. For example, the serrated grippers 22 may be replaced in whole, or in part, by grippers 22 of any other suitable construction such as grippers 22 which comprise a portion of the sides 19, 21 of the wing channel 16 which is a rough surface of any suitable nature. In addition, regardless of their construction, the grippers 22 may not extend the full height or full length of the sides 19, 21 of the wing channel 20, and there may be fewer, or more, grippers 22 than are illustrated in the Figures. If grippers 22 are used on both sides 19, 21 of the wing channel 20, the grippers 22 on each side 19, 21 of the wing channel 20 may, or may not, be of the same size, shape and construction.

Alternatively, the wing channel 20 may have a U-shaped cross-sectional configuration, like the U-shaped boss channels 26 between the boss 18 and the wings 16 that are described below, and may serve one or more of the functions of the U-shaped boss channels 26. A limitation on such an alternative may be that the wing channel 20 or at least one of the boss channels 26, must be sized and shaped to enable it to releasably secure the lace 24.

The boss channels 26 may have any suitable size, shape and cross-sectional configuration that enable the boss channels 26 to be used with a lace 24 having any particular size, shape, construction and cross-sectional configuration. Both boss channels 26 may, or may not, have the same size, shape and cross-sectional configuration. Although two boss channels 26 are illustrated, there may be only one boss channel 26.

The size, shape and cross-sectional configuration of a boss channel 26 may be selected to enable it to serve the function of guiding the lace 24 out of the lace lock 10 without securing the lace 24. Alternatively, the size, shape and cross-sectional configuration of a boss channel 26 may be selected to enable it to serve the function of releasably securing the lace 24.

By way of example, a boss channel 26 may have a U-shaped cross-sectional configuration (i.e., "U-shaped"), as illustrated in the Figures. The term "U-shaped" is given a broad meaning to include a boss channel 26 that has at least a generally U-shaped cross-sectional configuration. For example, the upper portion of a U-shaped boss channel 26 may be wider than its lower portion to make introducing the lace 24 into a U-shaped boss channel 26 easier; and the bottom portion of a U-shaped boss channel 26 may be rounded or flat. The minimum width of a U-shaped boss channel 26 may be selected to be sufficient so that it does not releasably secure the lace 24 passing through it.

Alternatively, the minimum width of a U-shaped boss channel 26 may be selected so that it does releasably secure the lace 24. For example, a U-shaped boss channel 26 may have an hour-glass shaped cross-sectional configuration (i.e., "hour-glass shaped"), with the narrow portion of the hour-glass shape being sized and shaped so that an hour-glass shaped boss channel 26 is operable to releasably secure the lace 24. Part, or all of such an hour-glass shaped boss channel 26 may be equipped with grippers 22.

As a further alternative, all or part of one or both of the sides 25, 27 of a U-shaped boss channel 26 may be equipped with grippers 22 that are the same as, or at least similar to the grippers 22 of the wing channel 20. As another alternative, all or part of one or both of the boss channels 26 may be V-shaped like the wing channel 20 described above, and may perform one or more of the functions of a V-shaped wing channel 20.

Figure 4:
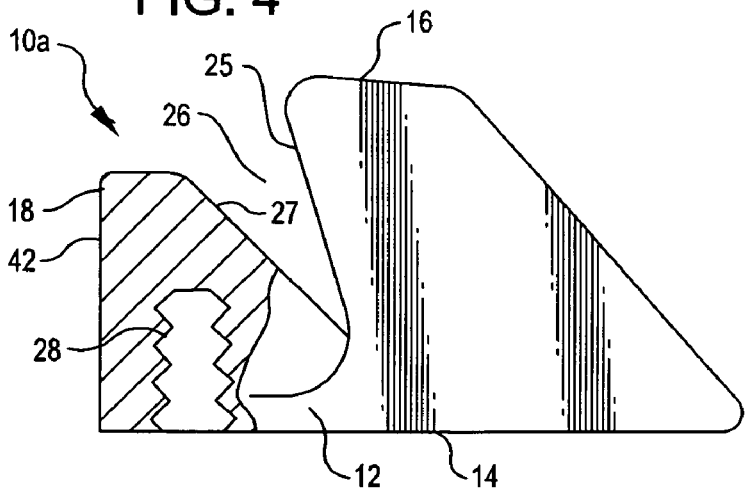
FIG. 4 is a side elevational view of a second embodiment of the lace lock, shown partly in cross section.

Turning now to FIG. 4, it illustrates a lace lock boa that is the same as the lace lock 10 of FIGS. 1-3 and 6, except that the bore 28 for the base 12 and the mounting screw 36 is at a right angle to the bottom 14 of the lace lock boa.

Figure 6:
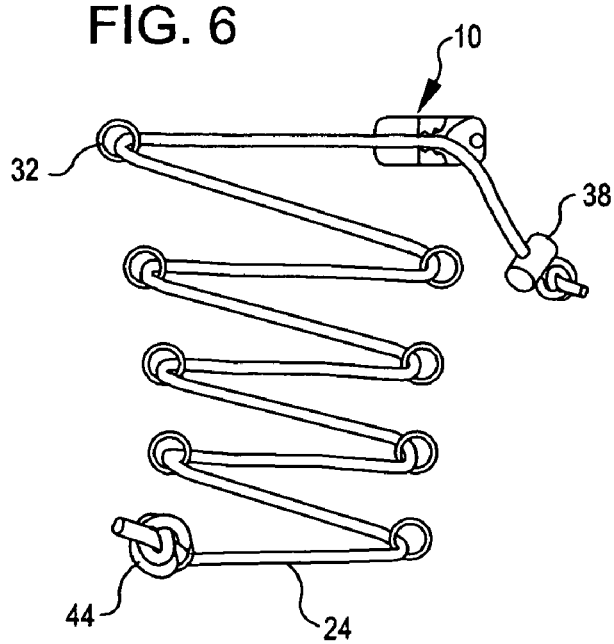
FIG. 6 is a diagrammatic front elevational view showing an alternative way to use the lace lock of FIGS. 1-3.
Figure 7:
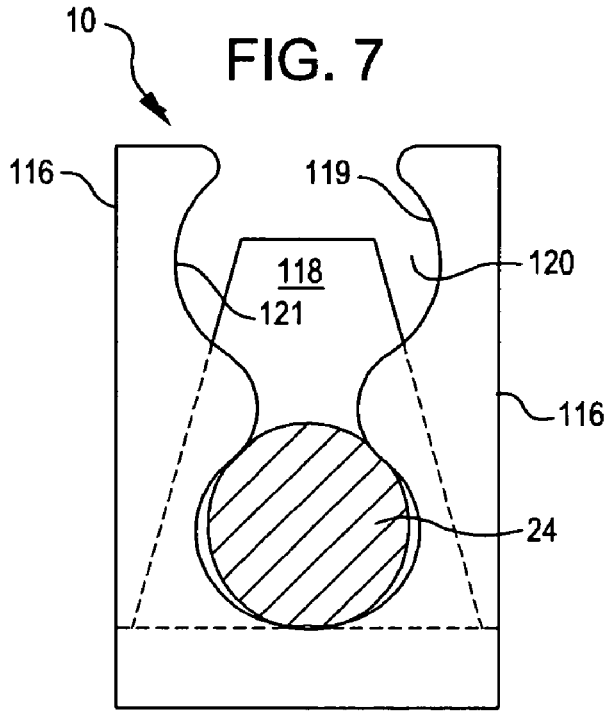
FIG. 7 is a perspective view of a lace lock having an hour-glass shaped wing channel.
Figure 8:
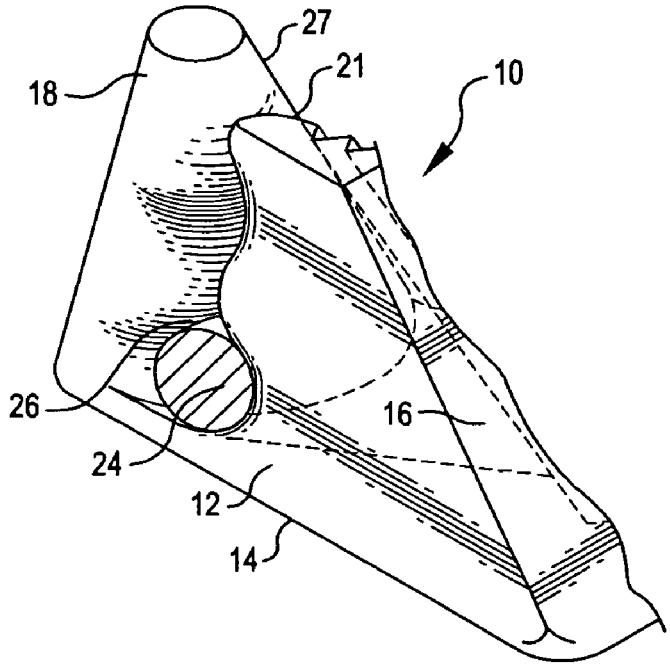
FIG. 8 is a perspective view of a lace lock having an hour-glass shaped boss channel.

Turning now to FIG. 6 it shows, in a diagrammatic fashion, how a single lace lock 10 may be used to releasably secure a free end portion of a lace 24 on any article, such as an article of footwear 30, in a situation where the lace 24 has only one free end portion. The lace lock 10 may be mounted to the footwear 30 in any suitable way, such as in any of the ways that have been described above. As seen in FIG. 6, one end of the lace may be secured in place on the footwear 30 in any suitable way, such as by tying a knot 44 in one end of the lace 24, and by then threading the lace 24 through the eyelets 32 in the manner shown in FIG. 6. The lace lock 10 may then be used, as has been described, to releasably secure a free end portion of the lace 24.

Figure 5:
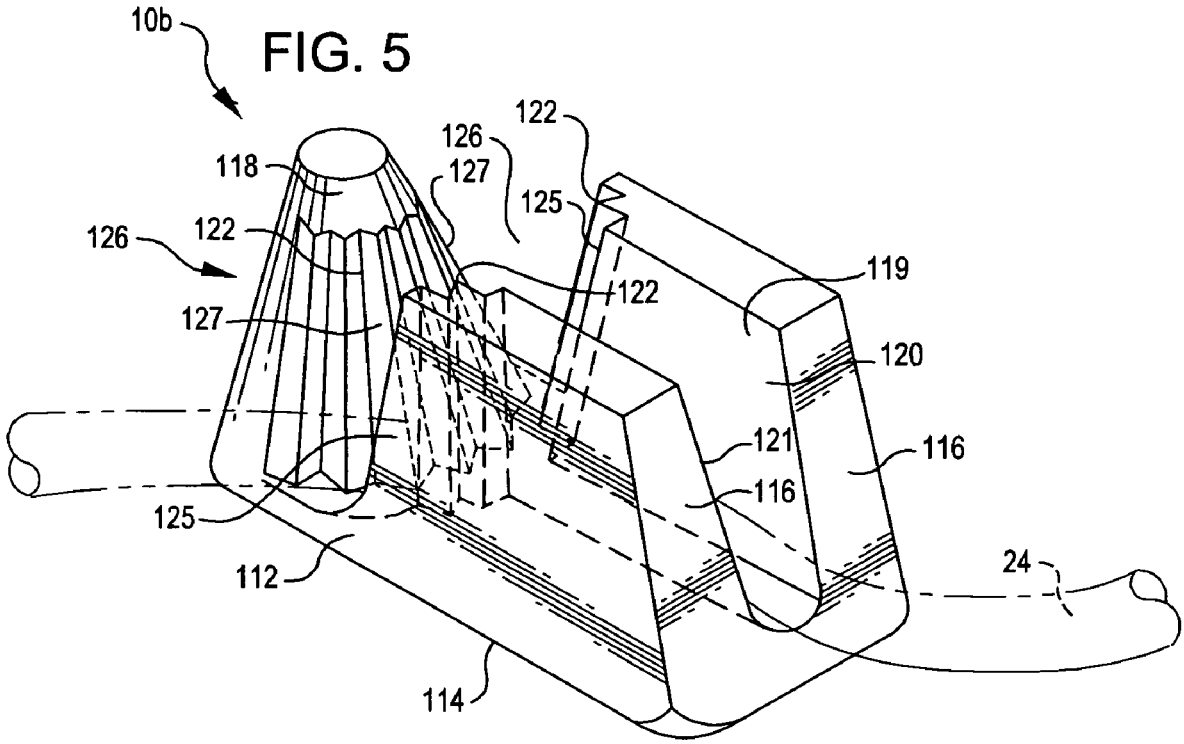
FIG. 5 is a front, side perspective view of a third embodiment of the lace lock.

Turning now to FIG. 5, it illustrates a lace lock 10*b*. It is understood that the lace locks 10, 10*a*, and 10*b* and their various parts, components or elements are the same as each other, or are at least similar to each other, in any particular respect such as with respect to their respective mountings, locations, physical features, physical properties, quantities (how many), sizes, shapes, designs, materials, compositions, constructions, manufactures, dimensions, specifications, variations, operations, methods and uses, except for those differences which will be made apparent by all of the disclosures herein. Accordingly, for clarity and simplicity, certain parts of the lace lock 10*b* of FIG. 5 have been given the same reference numerals, with a "1" prefix, as the reference numerals used for the corresponding respective parts of the lace locks 10 and 10*a* of FIGS. 1-4 and 6.

Turning again to FIG. 5, the wing channel 120 between the wings 116 may have any suitable size, shape and cross-sectional configuration that enable it to be used with a lace 24 having any particular size, shape, construction and cross-sectional configuration. The size, shape and cross-sectional configuration of the wing channel 120 may be selected to enable it to serve the function of guiding the lace 24 into the lace lock 10*b* without securing the lace 24.

By way of example, the wing channel 120 may have a generally U-shaped cross-sectional configuration, as illustrated in FIG. 5. The term "U-shaped" is given a broad meaning to include a wing channel 120 that is at least generally U-shaped. For example, the upper portion of a U-shaped wing channel 120 may be wider than its lower portion to make introducing the lace 24 into a U-shaped wing channel 120 easier; and the bottom portion of a U-shaped wing channel 120 may be rounded or flat. The minimum width of a U-shaped wing channel 120 may be selected to be sufficient so that it does not releasably secure the lace 24 passing through it.

Alternatively, the size, shape and cross-sectional configuration of the channel 120 may be selected to enable it to serve the function of releasably securing the lace 24. For example, the minimum width of a U-shaped wing channel 120 may be selected so that it does releasably secure the lace 24. For example, a U-shaped wing channel 126 may have an hour-glass shaped cross-sectional configuration (i.e., "hour-glass shaped"), with the narrow portion of the hour-glass shape being sized and shaped so that an hour-glass shaped wing channel 126 is operable to releasably secure the lace 24. Part, or all, of such an hour-glass shaped wing channel 126 may be equipped with grippers 122.

As a further alternative, all or part of the sides 119, 121 of the wing channel 126 may be equipped with grippers 122 that are the same as, or at least similar to, the grippers 22 of the wing channel 20 of the lace lock 10. As a further alternative, all or part of the wing channel 120 may be V-shaped, like the wing channel 20 of the lace lock 10, for releasably securing the lace 24.

The boss channels 126 may have any suitable size, shape and cross-sectional configuration that enable the boss channels 126 to be used with a lace 24 having any particular size, shape, construction and cross-sectional configuration. Both boss channels 126 may, or may not, have the same size, shape and cross-sectional configuration. Although two boss channels 126 are illustrated, there may be only one boss channel 126.

The size, shape and cross-sectional configuration of a boss channel 126 may be selected to enable it to serve the function of releasably securing the lace 24. For example, a boss channel 126 may have a V-shaped cross-sectional configuration, as illustrated in FIG. 5. Although an entire boss channel 126 is illustrated as being V-shaped, only part of a boss channel 126 may be V-shaped.

The width of the top of a V-shaped boss channel 126 may be selected to enable the lace 24 to easily enter a boss channel 126. The width of a lower portion of a V-shaped boss channel 126 may be selected to enable a V-shaped boss channel 126 to releasably secure the lace 24. The size, shape and dimensions of a V-shaped boss channel 126 may be varied, as needed, in order to permit a V-shaped boss channel 126 to releasably secure a lace 24 having any particular size, shape, construction and cross-sectional configuration.

All or part of the sides 125, 127 of a boss channel 126 may comprise optional grippers 122 which may serve the function of helping the sides 125, 127 of a boss channel 126 to releasably secure a lace 24 with which the lace lock 10*b* may be used. Although elongated, serrated grippers 122 are illustrated, it is understood that the grippers 122 may have any other suitable size, shape and construction that helps enable the grippers 122 to perform their function. For example, the serrated grippers 122 may be replaced in whole, or in part, by grippers 122 of any other suitable construction such as grippers 122 which comprise a portion of the sides 125, 127 of a boss channel 126 which is a rough surface of any suitable nature. In addition, regardless of their construction, the grippers 122 may not extend the full height or full length of a boss channel 126, and there may be fewer, or more, grippers 122 than are illustrated in FIG. 5. If grippers 122 are used on the sides 125, 127 of a boss channel 126 the grippers 122 on each side may, or may not, be of the same size, shape and construction.

As further alternative, the size, shape and cross-sectional configuration of a boss channel 126 may be selected to enable it to serve the function of guiding the lace 24 out of the lace lock 10*b* without securing the lace 24. For example, all or part of a boss channel 126 may be U-shaped, like a U-shaped boss channel 26 of the lace lock 10, and may serve one or more of the functions of a U-shaped boss channel 26. A limitation on such an alternative may be that the wing channel 120 or at least one of the boss channels 126, must be sized and shaped to enable it to releasably secure the lace 24.

From the forgoing, it will be appreciated that specific embodiments of the invention have been described herein for purposes of illustration, and that various modification may be made without deviating from the invention. Additionally, aspects of the invention described in the context of particular embodiments may be combined or eliminated in other embodiments. Although advantages associated with certain embodiments of the invention have been described in the context of those embodiments, other embodiments may also exhibit such advantages. Further, not all embodiments need necessarily exhibit such advantages to fall within the scope of the claimed invention.

When the phrase "at least one of" is used in any of the claims, that phrase is defined to mean that any one, any more than one, or all, of the listed things or steps following that phrase is, or are, part of the claimed invention. For example, if a hypothetical claim recited "at least one of A, B, and C", then the claim is to be interpreted so that it may comprise (in addition to anything else recited in the claim), an A alone, a B alone, a C alone, both A and B, both A and C, both B and C, or all of A, B and C.

Before an element in a claim is construed as claiming a means for performing a specified function under 35 USC section 112, last paragraph, the words "means for" must be used in conjunction with that element.

It is understood that the foregoing forms of the invention were described and illustrated strictly by way of non-limiting example. As used herein, except in the claims, the words "and" and "or" are each defined to also carry the meaning of "and/or".

In view of all of the disclosures herein, these and further modifications, adaptations and variations of the present invention will now be apparent to those of ordinary skill in the art to which it pertains, within the scope of the following claims.

What is claimed is:

1. A lace lock; wherein said lace lock is operable to releasably secure a free end portion of a lace, wherein said lace lock comprises:

a base having a top surface and a bottom surface;

a boss supported by said base;

a pair of wings supported by said base;

a wing channel defined between said pair of wings, wherein said wing channel is operable to receive said lace; wherein said boss and said pair of wings extend outwardly from said top surface of said base; and wherein said boss is at least generally aligned with said wing channel;

a fastener bore in said boss and said base that is operable to receive a fastener; wherein said fastener is operable to mount said lace lock to an article; wherein said article comprises a first part and a second part; wherein at least part of said bottom surface of said base is in contact with said first part of said article when said lace lock is mounted to said first part of said article; and wherein said second part of said article comprises said lace; and a boss channel defined between said boss and one of said wings, wherein said boss channel is operable to receive said lace;

wherein at least one of said wing channel and said boss channel are operable to releasably secure said free end portion of said lace.

2. The lace lock according to claim 1, wherein only said wing channel is operable to releasably secure said lace.

3. The lace lock according to claim 1, wherein only said boss channel is operable to releasably secure said lace.

4. The lace lock according to claim 1, wherein both said wing channel and said boss channel are operable to releasably secure said lace.

5. The lace lock according to claim 1, wherein said lace lock comprises a first said boss channel and a second said boss channel.

6. The lace lock according to claim 1, wherein at least a portion of at least one of said wing channel and said boss channel is V-shaped.

7. The lace lock according to claim 6, wherein said lace lock further comprises at least one gripper located on at least part of said portion of at least one of said wing channel and said boss channel that is V-shaped.

8. The lace lock according to claim 1, wherein at least a portion of at least one of said wing channel and said boss channel is hour-glass shaped.

9. The lace lock according to claim 8, wherein said lace lock further comprises at least one gripper located on at least part of said portion of at least one of said wing channel and said boss channel that is hour-glass shaped.

10. The lace lock according to claim 1, wherein at least a portion of at least one of said wing channel and said boss channel is U-shaped.

11. The lace lock according to claim 10, wherein said lace lock further comprises at least one gripper located on at least part of said portion of at least one of said wing channel and said boss channel that is U-shaped.

12. The lace lock according to claim 1, wherein a particular one of said wing channel and said boss channel is not operable to releasably secure said lace.

13. The lace lock according to claim 12, wherein said particular one is U-shaped.

14. The lace lock according to claim 12, wherein said wing channel is not operable to releasably secure said lace.

15. The lace lock according to claim 12, wherein said boss channel is not operable to releasably secure said lace.

16. The lace lock according to claim 1, wherein said lace lock further comprises said fastener.

17. The lace lock according to claim 16, wherein said lace lock further comprises said article; and wherein said article comprises an article of footwear.

* * * * *